US008492669B2

(12) United States Patent
Yen

(10) Patent No.: US 8,492,669 B2
(45) Date of Patent: Jul. 23, 2013

(54) KEY DEVICE

(75) Inventor: Ming-Fu Yen, Taipei (TW)

(73) Assignees: Silitek Electronic (Guangshou), Co., Ltd., Guangzhou (CN); Lite-On Technology Corp., Taipei (TW)

( * ) Notice: Subject to any disclaimer, the term of this patent is extended or adjusted under 35 U.S.C. 154(b) by 220 days.

(21) Appl. No.: 13/158,664

(22) Filed: Jun. 13, 2011

(65) Prior Publication Data

US 2012/0048698 A1 Mar. 1, 2012

(30) Foreign Application Priority Data

Aug. 27, 2010 (CN) ..... 2010 1 0266123

(51) Int. Cl.
*H01H 13/70* (2006.01)

(52) U.S. Cl.
USPC ..... 200/344; 200/517; 200/301

(58) Field of Classification Search
USPC ..... 200/344, 343, 301, 5 A, 511–512, 200/517
See application file for complete search history.

(56) References Cited

U.S. PATENT DOCUMENTS

| | | | | |
|---|---|---|---|---|
| 5,504,283 | A * | 4/1996 | Kako et al. | 200/5 A |
| 6,002,092 | A * | 12/1999 | Pan | 200/344 |
| 6,815,627 | B2 * | 11/2004 | Chen | 200/344 |
| 7,183,512 | B2 * | 2/2007 | Lee et al. | 200/344 |
| 7,994,446 | B2 * | 8/2011 | Chao | 200/344 |

* cited by examiner

*Primary Examiner* — Xuong Chung Trans
(74) *Attorney, Agent, or Firm* — Rosenberg, Klein & Lee

(57) ABSTRACT

A key device includes a plate body, a positioning seat having a through hole, a circuit unit mounted on the plate body, a keycap disposed above the circuit unit, and an elastic member disposed between the circuit unit and the keycap. The circuit unit includes a multi-layered structure, and a resilient tongue provided on one layer of the multi-layered structure and having a free end proximate to the through hole. A support rod is connected to and supports the keycap on the substrate, and has a lower end extending through the through hole. The free end of the resilient tongue extends beneath and abuts against the lower end of the support rod, and pushes upwardly the lower end of the support rod to abut against an edge confining the through hole.

18 Claims, 13 Drawing Sheets

KEY DEVICE

CROSS-REFERENCE TO RELATED APPLICATION

This application claims priority of Chinese Application No. 201010266123.1, filed on Aug. 27, 2010.

BACKGROUND OF THE INVENTION

1. Field of the Invention

This invention relates to a key device, and more particularly to a structural improvement of a key device.

2. Description of the Related Art

Referring to FIG. 1, a conventional key device of a computer keyboard generally includes a substrate 91, a circuit unit 92 mounted on the substrate 91, a keycap 93, and an elastic member 95 and a substantially U-shaped support rod 94 disposed between the circuit unit 92 and the keycap 93. The substrate 91 includes two spaced-apart positioning seats 911 (only one is visible), each of which has a through hole. The support rod 94 has a bight portion (not visible) connected pivotally to the keycap 93, and two leg portions 941 (only one is visible) connected respectively to two opposite ends of the bight portion. Each leg portion has a lower end extending through the respective through hole. However, since a gap usually exists between the lower end of the leg portion 941 and an edge confining the through hole when the keycap 93 is pressed, when the keycap 93 is released from being pressed, the lower end of the leg portion 941 frequently bumps onto the edge confining the through hole, thereby creating noise. Hence, when the key device absorbs vibrations, a touch action, or a press action, the movement of each leg portion 941 inside the through hole in the respective positioning seats 911 easily produces noise.

SUMMARY OF THE INVENTION

Therefore, the object of the present invention is to provide a key device that can minimize noise produced by a pin in a hole due to vibrations, a touch action, or a press action.

According to one aspect of this invention, a key device comprises a substrate, a circuit unit, a keycap, an elastic member, and a support rod. The substrate includes a plate body, and a positioning seat provided on a top face of the plate body and having a through hole. The circuit unit is mounted on the top face of the plate body, and includes a multi-layered structure, and a resilient tongue provided on one layer of the multi-layered structure. The resilient tongue has a free end proximate to the through hole. The keycap is disposed above the circuit unit. The elastic member is disposed between the circuit unit and the keycap. The support rod is connected to and supports the keycap on the substrate, and has a lower end extending through the through hole. The free end of the resilient tongue extends beneath and abuts against the lower end of the support rod, and pushes upwardly the lower end of the support rod to abut against an edge confining the through hole.

According to another aspect of this invention, a key device comprises a substrate, a sheet body, an elastic member, a keycap, and a support rod. The substrate includes a plate body, and a positioning seat provided on a top face of the plate body and having a through hole. The sheet body is disposed on the top face of the plate body, and is formed with a resilient tongue having a free end proximate to the through hole. The elastic member is arranged on the sheet body. The keycap is disposed on the elastic member. The support rod is connected to the keycap, and has a lower end extending through the through hole. The free end of the resilient tongue extends beneath and abuts against the lower end of the support rod, and pushes upwardly the lower end of the support rod to abut against an edge confining the through hole.

The efficiency of the present invention resides in the fact that through the resilient tongue that supports the lower end of the support rod, the lower end of the support rod can be pushed to abut against the positioning seat, thereby eliminating a gap between the lower end of the support rod and the edge of the positioning seat. This can prevent the lower end of the support rod from bumping against the edge of the positioning seat and produce noise.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
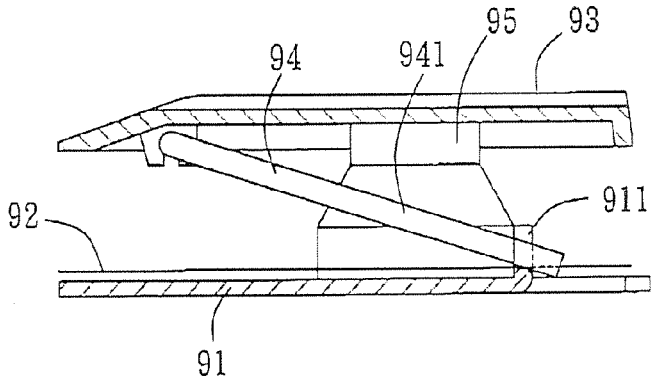
F I G. 1 PRIOR ART
FIG. 1 is a sectional view of a conventional key device of a computer keyboard.
Figure 2:
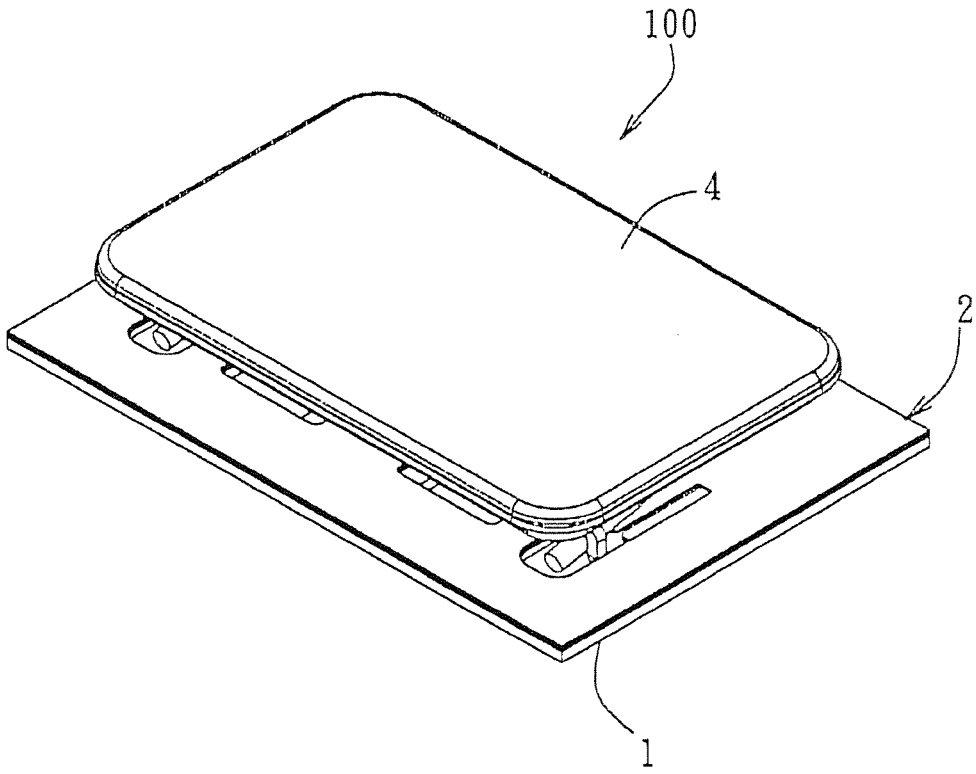
FIG. 2 is a perspective view of a key device according to the first preferred embodiment of the present invention.

The above-mentioned and other technical contents, features, and effects of this invention will be clearly presented from the following detailed description of three preferred embodiments in coordination with the reference drawings.

Before this invention is described in detail, it should be noted that, in the following description, similar elements are designated by the same reference numerals.

A key device of the present invention may be a key device of a computer keyboard, but is not limited thereto. Alternatively, the key device of the present invention may be a key device of an electronic device, a numerical keyboard, etc. To facilitate understanding of the present invention, only one key device of the computer keyboard will be exemplified in the below preferred embodiments.

Referring to FIGS. 2 to 7, a key device 100 according to the first preferred embodiment of the present invention comprises a substrate 1, a circuit unit 2, a support rod 3, a keycap 4, and an elastic member 5. The key device 100 may further comprise other support elements or components (not shown), such as a scissors-like member.

The substrate 1 includes e plate body 11 having a top face 111, and a plurality of positioning seats 12 connected to the top face 111 of the plate body 11. Each positioning seat 12 is formed with a through hole 121 that extends horizontally. "Extends horizontally" means an extending direction (D2) of the through hole 121 that is substantially parallel to the top face 111 of the plate body 11.

In this embodiment, each positioning seat 12 is made by punching a portion of the plate body 11 and then bending the portion upwardly to form an inverted U-shaped structure 122. The inverted U-shaped structure 122 has an edge 1221 (see FIG. 7) confining the through hole 121.

The circuit unit 2 is mounted on the top face 111 of the plate body 11 of the substrate 1, and includes a multi-layered structure and a plurality of resilient tongues 24. In this embodiment, the multi-layered structure includes a first circuit layer 21, a second circuit layer 22 disposed above the first circuit layer 21, and an intermediate circuit layer 23 disposed between the first and second circuit layers 21, 22. The first circuit layer 21, the intermediate circuit layer 23, and the second circuit layer 22 are superimposed one above the other. In this embodiment, each of the first circuit layer 21, the intermediate circuit layer 23, and the second circuit layer 22 is made of a PET (polyethylene terephthalate) material. A top face of the first circuit layer 21 and a bottom face of the second circuit layer 22 are each provided with an electrical circuit (not shown)

In this embodiment, the elastic member 5 is disposed on a top face of the second circuit layer 22, and is made of a material, such as silicone. When the elastic member 5 is depressed, it can force the second circuit layer 22 that is positioned below a bottom side of the elastic member 5 to contact directly the first circuit layer 21 that is positioned below the bottom side of the elastic member 5 to form an electrical connection.

Figure 3:
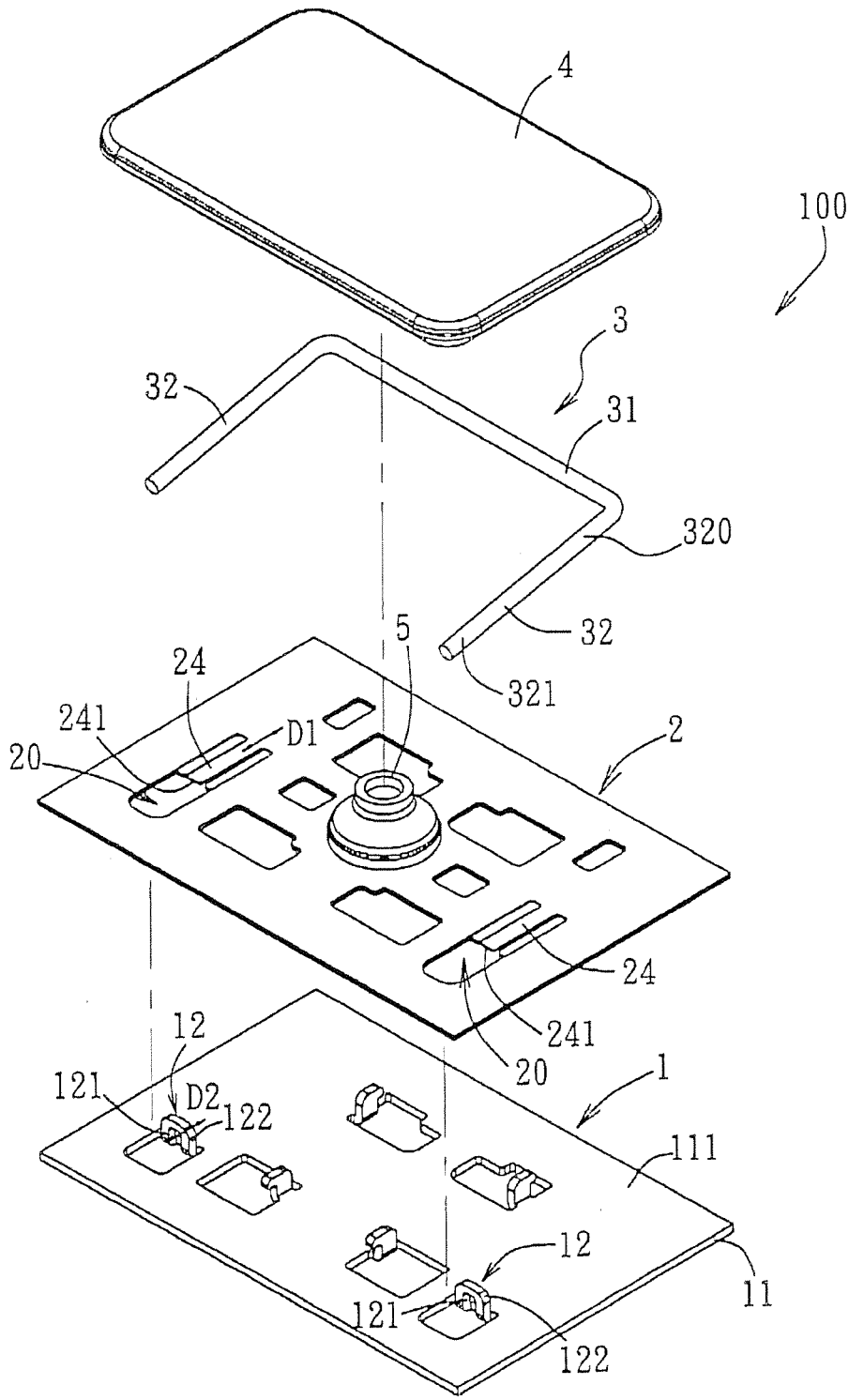
FIG. 3 is an exploded perspective of the first preferred embodiment.
Figure 4:
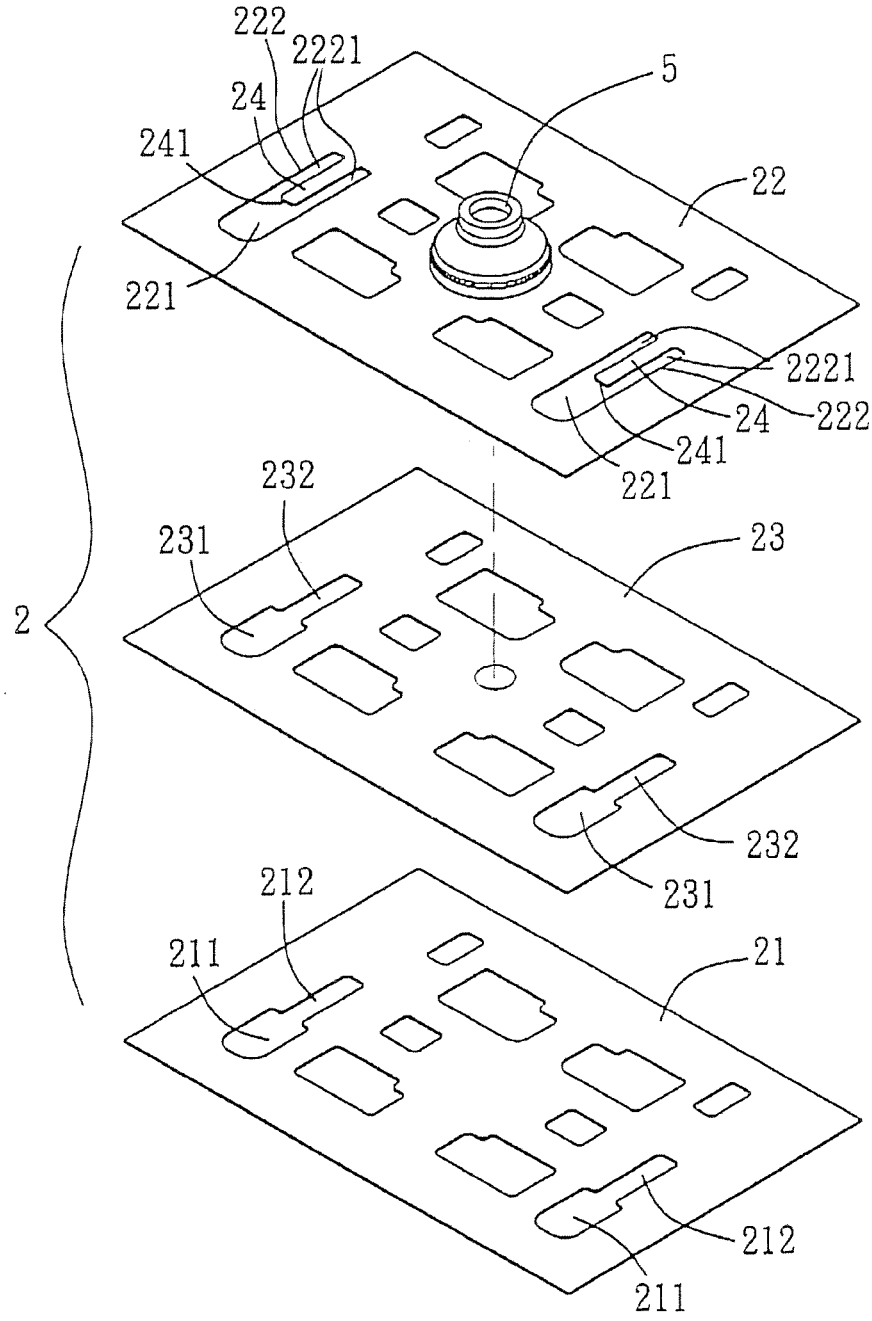
FIG. 4 is an exploded perspective view of a circuit unit of the first preferred embodiment.
Figure 7:
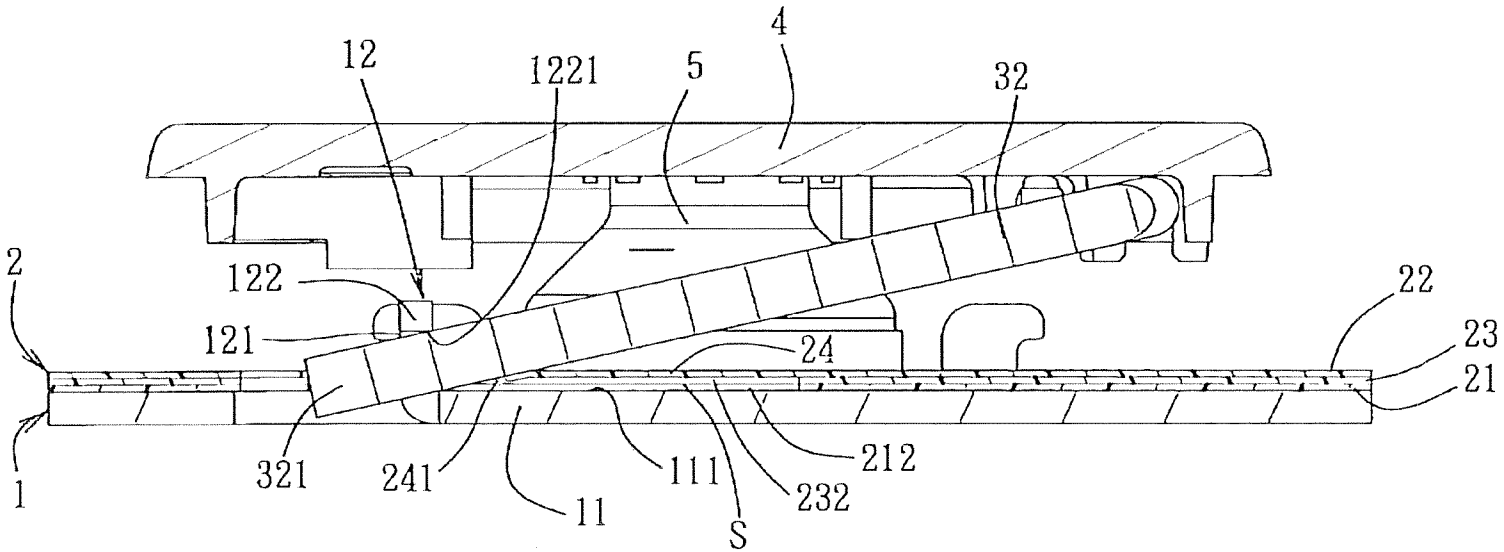
FIG. 7 is a sectional view of the first preferred embodiment in an assembled state.

The resilient tongues 24 are provided on one layer of the multi-layered structure, and, as shown in FIG. 7, when the circuit unit 2 is disposed on the top face 111 of the plate body 11 of the substrate 1, the resilient tongue 24 is spaced apart from the top face 111 of the plate body 11, and has a free end 241. In this embodiment, the second circuit layer 22 is formed with two first apertures 221 disposed on two opposite sides of the elastic member 5, respectively, and two first slots 222 each communicated with a respective first aperture 221. Each resilient tongue 24 is formed on the second circuit layer 22, and extends from the second circuit layer 22 into a respective first slot 222 to divide the first slot 222 into two parallel first slot portions 2221 both of which are communicated with one end of the corresponding first aperture 221. The first slot portions 2221 and the first aperture 221 cooperatively form a substantially U-shaped hole structure. As shown in FIG. 3, each resilient tongue 24 extends in a direction (D1) parallel to an extending direction (D2) of the respective through hole 121.

The first circuit layer 21 is formed with two second slots 212 each disposed below a respective resilient tongue 24, and two second apertures 211 each communicated with a respective second slot 212. The second slot 212 and the second aperture 211 cooperatively form a substantially T-shaped hole structure. The intermediate circuit layer 23 is formed with two third slots 232 each disposed below the respective resilient tongue 24 and communicated with the respective second slot 212, and two third apertures 231 each communicated with the respective third slot 232. The third slot 232 and the third aperture 231 cooperatively form a substantially T-shaped hole structure. With reference to FIG. 7, when the second circuit layer 22, the intermediate circuit layer 23, and the first circuit layer 21 are superimposed and interconnected, the second and third slots 212, 232 cooperatively form an indentation space (S) below the resilient tongue 24, so that the resilient tongue 24 can deform downward in the indentation space (S). Further, the first, third, and second openings 221, 231, 211 are communicated and aligned with each other and cooperatively define a hollow area 20. As the circuit unit 2 is disposed on the top face 111 of the plate body 111 of the substrate 1, the positioning seats 12 extend respectively through the hollow areas 20 in the circuit unit 2, so that the resilient tongues 24 face the respective positioning seats 12, and the free ends 241 of the resilient tongues 24 are proximate to the respective through holes 121.

Figure 5:
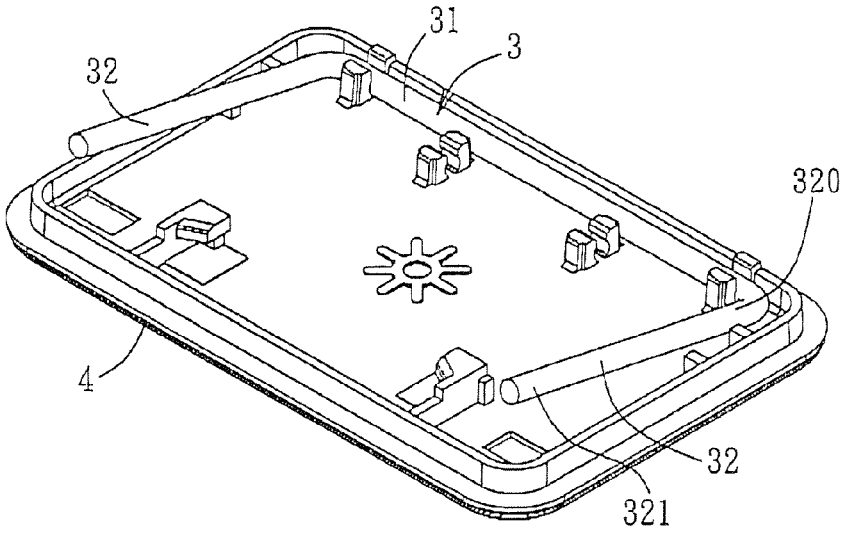
FIG. 5 is a bottom perspective view of the first preferred embodiment, illustrating how a support rod is engaged pivotally to a keycap.
Figure 6:
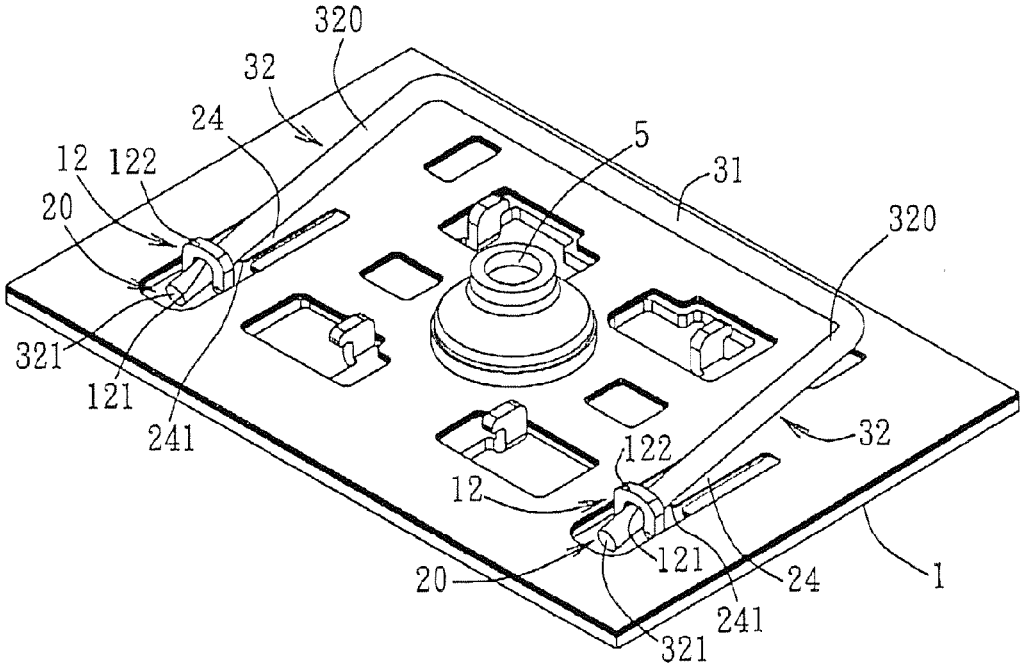
FIG. 6 is a perspective view of the first preferred embodiment in an assembled state, but without the keycap.

With reference to FIGS. 3, 5, and 7, the support rod 3 is substantially U-shaped, and includes two spaced-apart second rod sections 32, and a first rod section 31 connected between the second rod sections 32. Each of the second rod sections 32 has an upper end 320 connected integrally as one piece to one end of the first rod section 31, and a lower end 321 opposite to the upper end 320. The first rod section 31 is disposed on a bottom portion of the keycap 4, and is rotatable about its axis relative to the keycap 4, so that the second rod sections 32 are swingable around the axis of the first rod second 31 relative to the keycap 4. In this embodiment, the support rod 3 is a stabilizer bar for supporting the keycap 4 which has large dimensions. Alternatively, the support rod 3 may also be one of the arms of the scissors-like member. The lower ends 321 of the second rod sections 32 extend through the through holes 121 in the respective positioning seats 12 of the substrate 1 such that the second rod sections 32 are disposed respectively on the two opposite sides of the elastic member 5. At this time, the keycap 4 is disposed on top of and is supported by the elastic member 5. That is, the elastic member 5 is located below the keycap 4, and is disposed between the keycap 4 and the circuit unit 2. When the keycap 4 is not pressed, the second rod sections 32 are inclined with respect to the substrate 1. When the keycap 4 is depressed, the elastic member 5 is pressed downward, and the keycap 4 and the first rod section 31 of the support rod 3 are moved downward Proximate to the circuit unit 2. When pressing of the keycap 4 is released, the keycap 4 is biased to move away from the circuit unit 2 through the restoring force of the elastic member 5.

It should be noted that, in this embodiment, through the provision of the resilient tongues 24, when the support rod 3 is assembled between the keycap 4 and the substrate 1, the resilient tongues 24 are located just below the second rod sections 32 of the support rod 3, and the free ends 241 of the resilient tongues 24 abut respectively against the lower ends 321 of the second rod sections 32. Since each resilient tongue 24 is made of a PET material which is flexible and has a definite degree of rigidity, when the free end 241 of each resilient tongue 24 extends beneath and abuts against a bottom side of the lower end 321 of the respective second rod section 32, the free end 241 can push upward the respective second rod section 32, so that the lower end 321 of each second rod section 32 can abut against the edge 1221 of the inverted U-shaped structure 122 of the respective positioning seat 12, thereby eliminating a gap between the second rod section 32 and the edge 1221 of the inverted U-shaped structure 122. Thus, when the key device 100 vibrates due to an external force, the second rod sections 32 may be prevented from bumping onto the edge 1221 of the inverted U-shaped structure 122 to create low frequency noise. Further, since each resilient tongue 24 has a suspension arm structure, when the second rod sections 32 are pressed downward, the resilient tongues 24 also move downward along with the respective second rod sections 32 and deform downward without affecting the movement of the second rod sections 32.

In the first preferred embodiment, the support rod 3 is U-shaped, and includes the first rod section 31 and the two second rod sections 32. Alternatively, the support rod 3 may only include the two second rod sections 32 connected respectively to two opposite sides of the bottom portion of the keycap 4. In this case, the second rod sections 32 have the upper ends 320 connected, for instance, pivotally to the keycap 4 and the lower ends 321 extending through the respective through holes 121.

Figure 8:
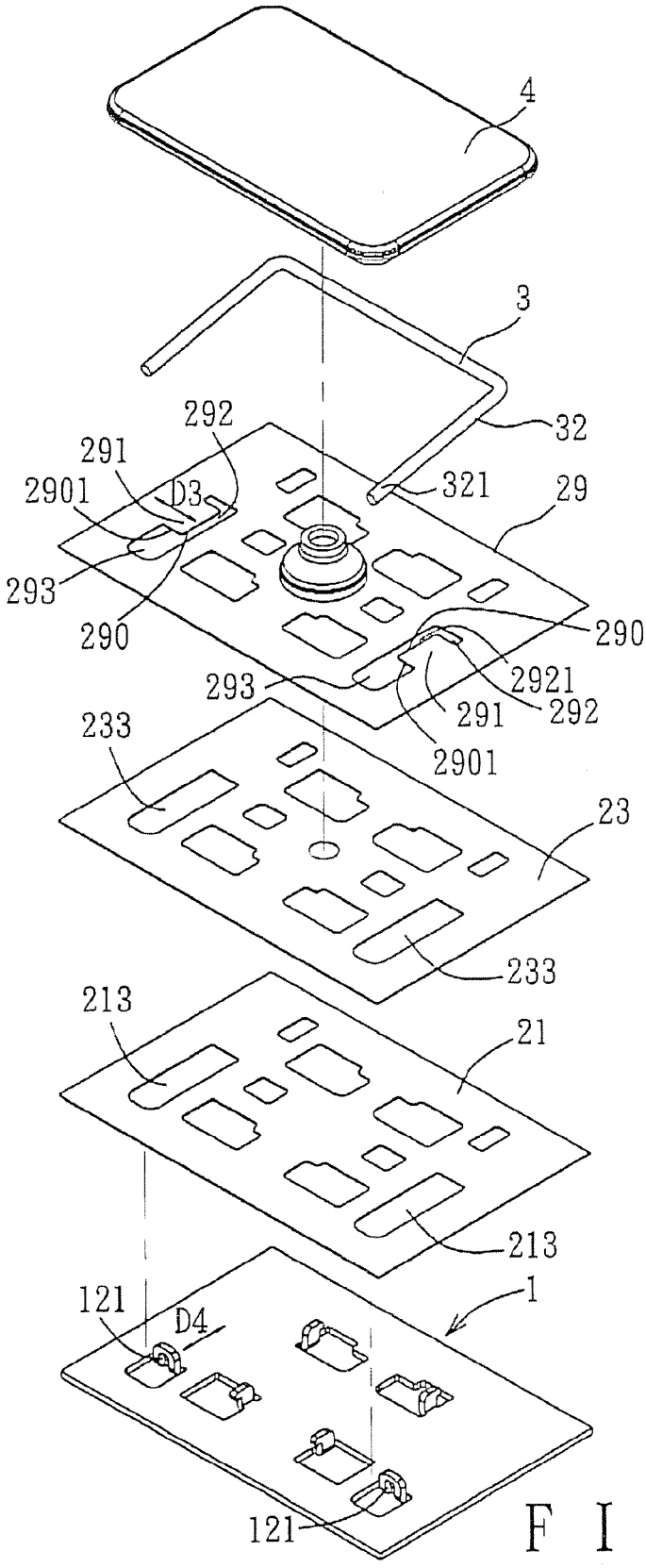
FIG. 8 is an exploded perspective of the first preferred embodiment, illustrating a first variation of resilient tongues on the circuit unit.

FIG. 8 illustrates a first variation of the resilient tongues 24. In FIG. 8, each resilient tongue 291 extends from the second circuit layer 29 into one of the first slots 292 such that each first slot 292 has a portion covered by the resilient tongue 291 and an L-shaped portion 2921 uncovered by the resilient tongue 291. The L-shaped portion 2921 has one end communicated with the first aperture 293. Each resilient tongue 291 extends in a direction (D3) perpendicular to the extending direction (D4) of the through hole 121. The free ends 290 of the resilient tongues 291 face each other. The free end 290 of each resilient tongue 291 extends from the second circuit layer 29 into the respective first slot 292. Specifically, an end portion 2901 of each resilient tongue 291 refers to a side end of the free end 290 of the respective resilient tongue 291 that faces the respective first aperture 293. The intermediate circuit layer 23 is formed with two slotted holes 233 disposed below the respective resilient tongues 291. The first circuit layer 21 is also formed with two slotted holes 213 disposed below the respective resilient tongues 291. Each slotted hole 233 of the intermediate circuit layer 23 and the corresponding slotted hole 213 of the first circuit layer 21 are aligned with each other and cooperatively form an indentation space (S) (see FIG. 7) below the respective resilient tongue 291, so that the resilient tongue 291 can deform downward in the indentation space (S) during operation of the key device. When the support rod 3 is connected to the substrate 1, the end portion 2901 of each resilient tongue 291 can similarly abut against the lower end 321 of the respective second rod section 32 of the support rod 3, thereby achieving an effect similar to that described above.

Figure 9:
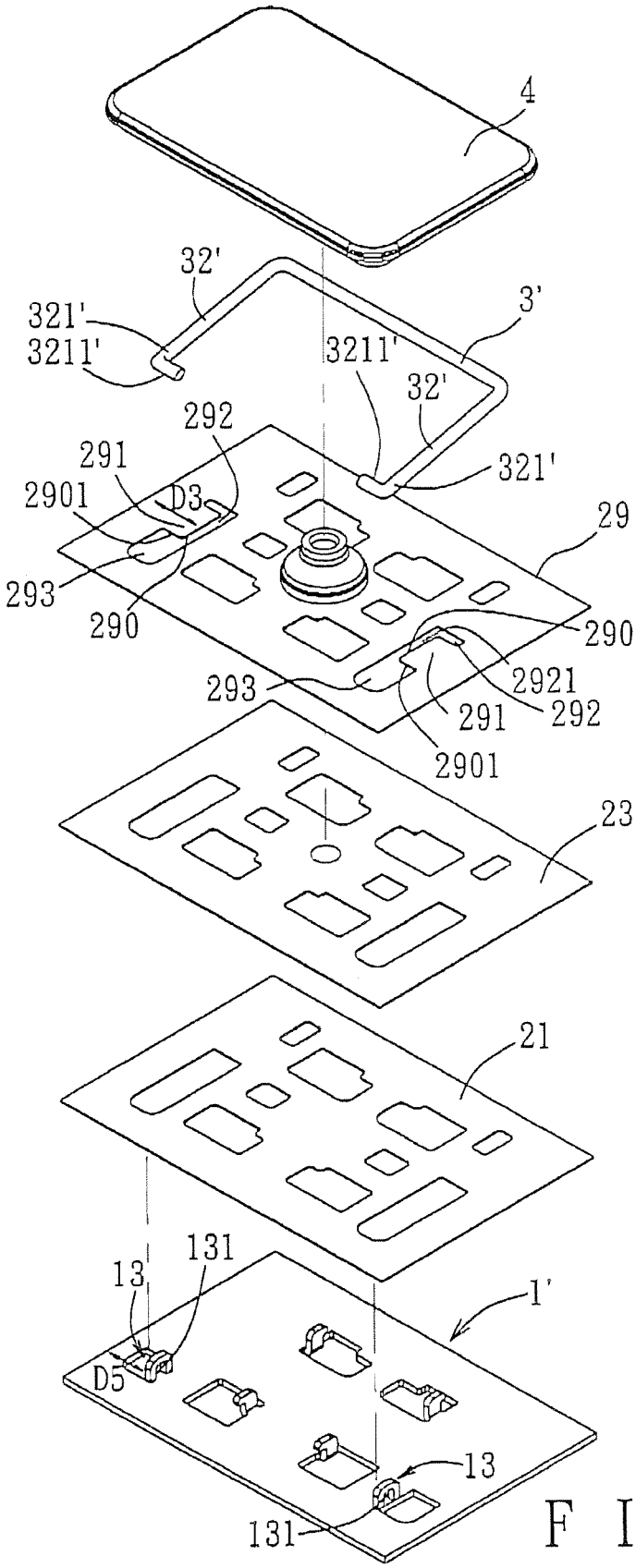
FIG. 9 is a view similar to FIG. 8, but illustrating an alternative form of the support rod.

Using the same configuration of the resilient tongues 291 shown in FIG. 8, with reference to FIG. 9, the lower ends 321' of the second rod sections 32' of the support rod 3' have an L-shaped configuration, and have bent legs 3211' extending in a direction toward each other and into the respective through holes 131. Corresponding to the structural change of the support rod 3', the extending direction (D5) of the through hole 131 of the positioning seat 13 of the substrate 1' is parallel to the extending direction (D3) of the respective resilient tongue 291. That is, the extending direction (D5) of the through hole 131 of each positioning seat 13, compared with the extending direction (D4) of the through hole 121 shown in FIG. 8, is changed and is rotated by an angle of 90° to match the direction of the lower end 321' of the respective second rod section 32'. As such, the lower ends 321' of the second rod sections 32' can similarly extend through the through holes 131 in the respective positioning seats 13.

When the support rod 3' is assembled to the substrate 1', the end portions 2901 of the free ends 290 of the resilient tongues 291 can similarly abut against the bent legs 3211' of the lower ends 321' of the respective second rod sections 32'. Hence, an effect described above can be similarly achieved.

Figure 10:
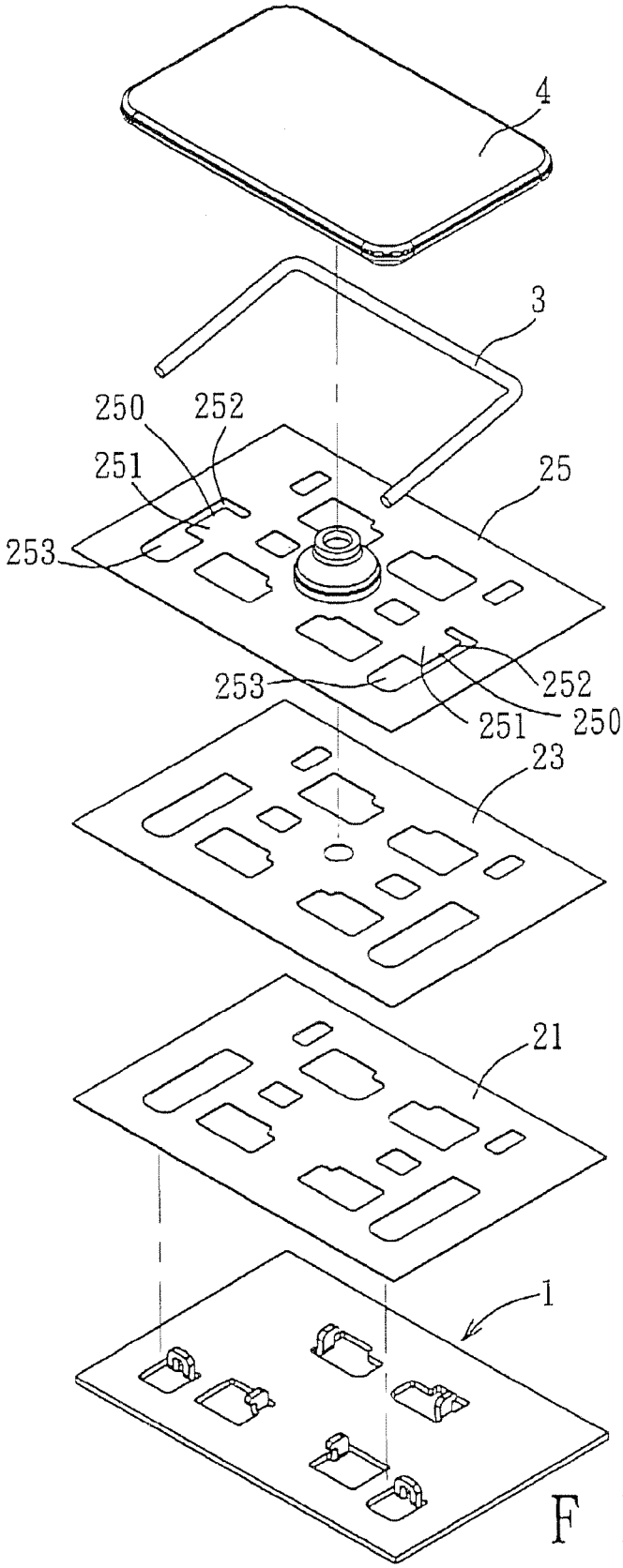
FIG. 10 is a view similar to FIG. 8, but illustrating a second variation of the resilient tongues on the circuit unit.

Referring to FIG. 10, a second variation of the resilient tongues 251 is shown to be similar to that of the resilient tongues 291 shown in FIG. 8. However, in this case, the free ends 250 of the resilient tongues 251 face each other in opposite directions.

Figure 11:
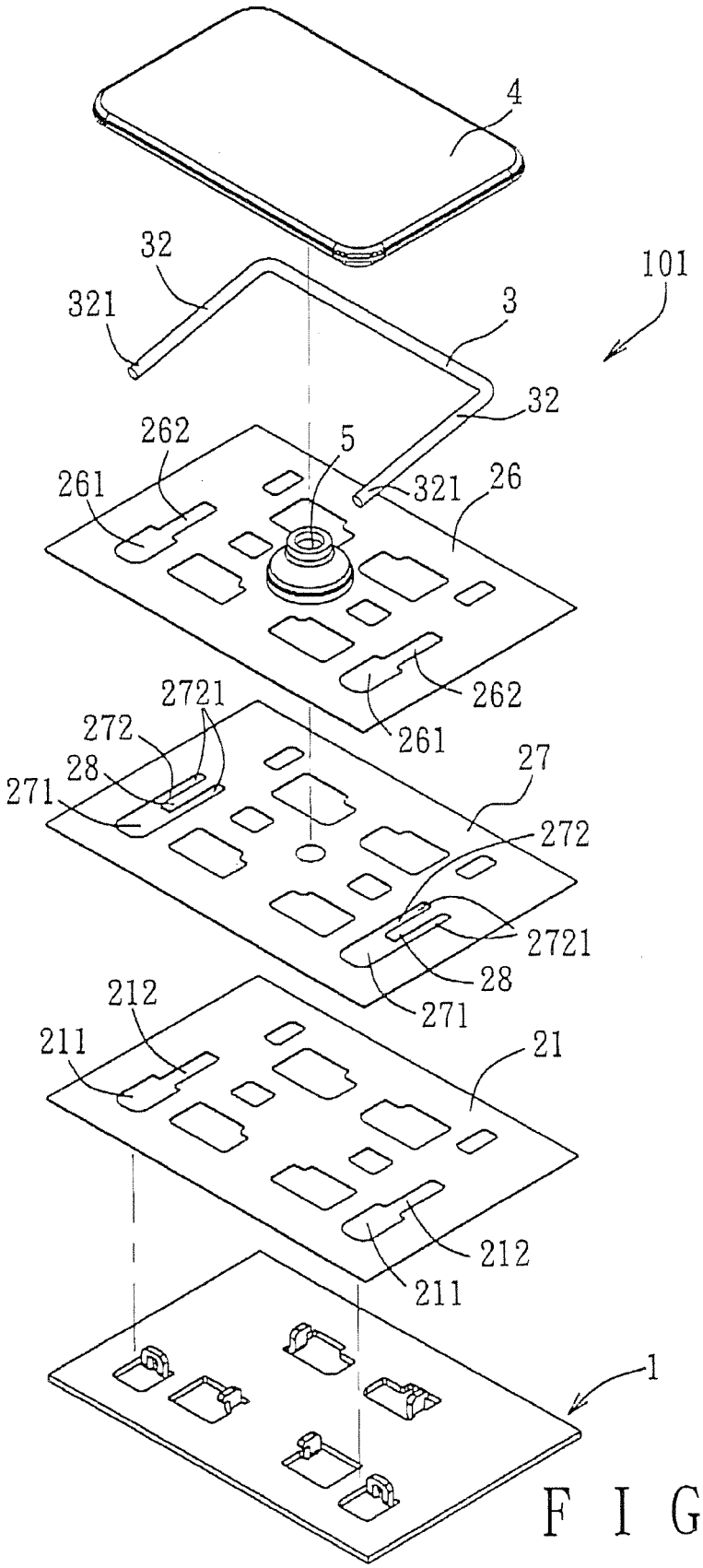
FIG. 11 is an exploded perspective view of a key device according to the second preferred embodiment of the present invention.
Figure 12:
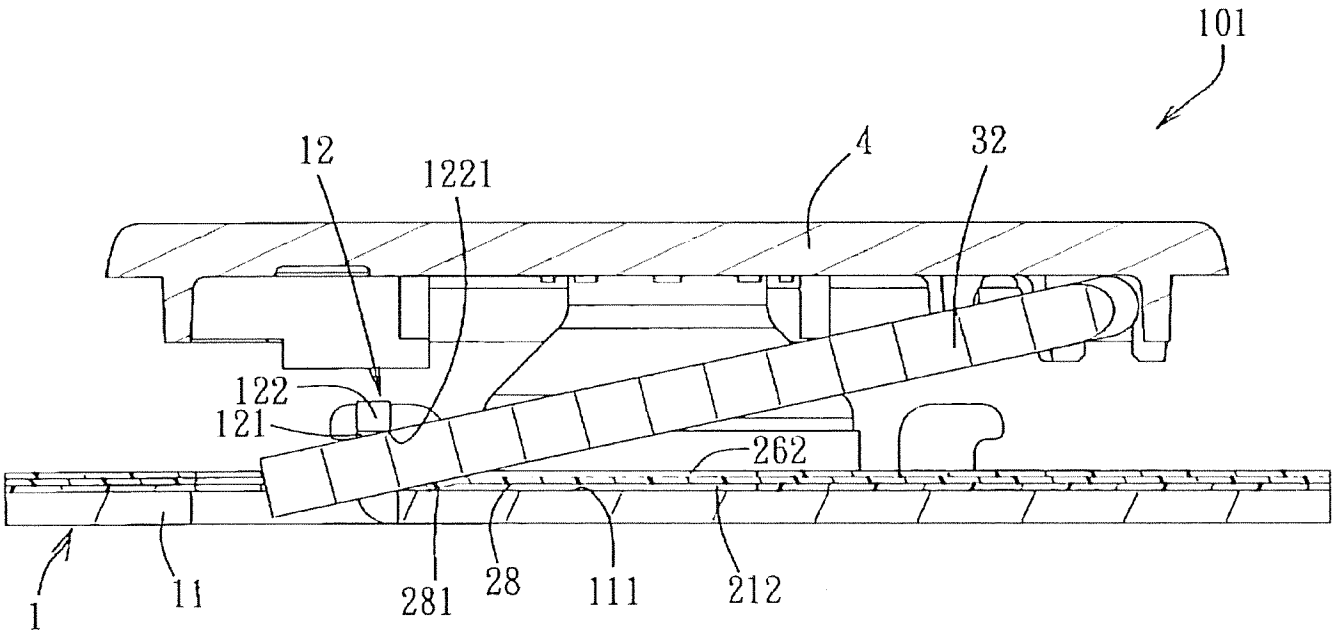
FIG. 12 is a sectional view of the second preferred embodiment in an assembled state.

Referring to FIGS. 11 and 12, a key device 101 according to the second preferred embodiment of the present invention is shown to be similar to the first preferred embodiment. However, in this embodiment, the resilient tongues 28 are provided on the intermediate circuit layer 27. The intermediate circuit layer 27 is formed with two spaced-apart first slots 272 disposed on the two opposite sides of the elastic member 5, respectively, and two first apertures 271 each communicated with a respective first slot 272. Each resilient tongue 28 extends into the respective first slot 272 to divide the first slot 272 into two parallel first slot portions 2721 both of which are communicated with one end of the corresponding first aperture 271. The first slot portions 2721 and the first aperture 271 cooperatively form a substantially U-shaped hole structure. The second circuit layer 26 is formed with two third slots 262 disposed respectively above the resilient tongues 28, and two third apertures 261 communicated with the respective third slots 262. Each third slot 262 and a respective third aperture 261 cooperatively define substantially T-shaped hole structure.

When the first circuit layer 21, the intermediate circuit layer 27, and the second circuit layer 26 are superimposed and interconnected, each resilient tongue piece 28 is disposed between the second slot 212 and the third slot 262. Through a space provided by the second slot 212, each resilient tongue 28 can be spaced apart from the top face 111 of the plate body 11 of the substrate 1. Further, the free end 281 thereof can extend beneath and abut against the lower end 321 of the respective second rod section 32, and can push upwardly the respective second rod section 32 to abut against the edge 1221 confining the through hole 121. Because the resilient tongue 28 shown in FIG. 12 is disposed lower than the resilient tongue 24 shown in FIG. 7, the resilient tongue 28 is longer than the resilient tongue 24 so as to be sufficient to push upward the respective second rod section 32 to abut against the edge 1221.

The resilient tongues 28 may also be configured as those shown in FIGS. 8 and 10.

Figure 13:
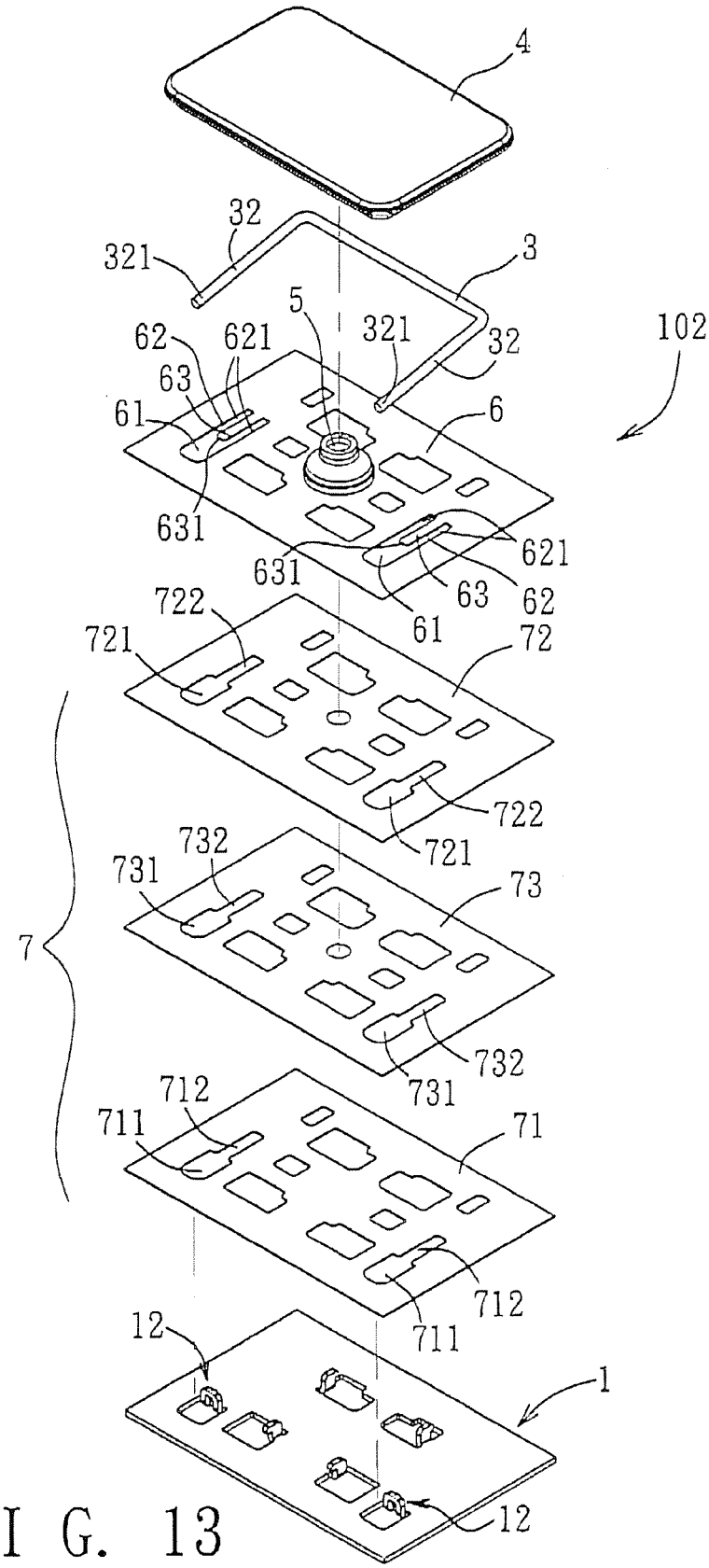
FIG. 13 is an exploded perspective view of a key device according to the third preferred embodiment of the present invention.
Figure 14:
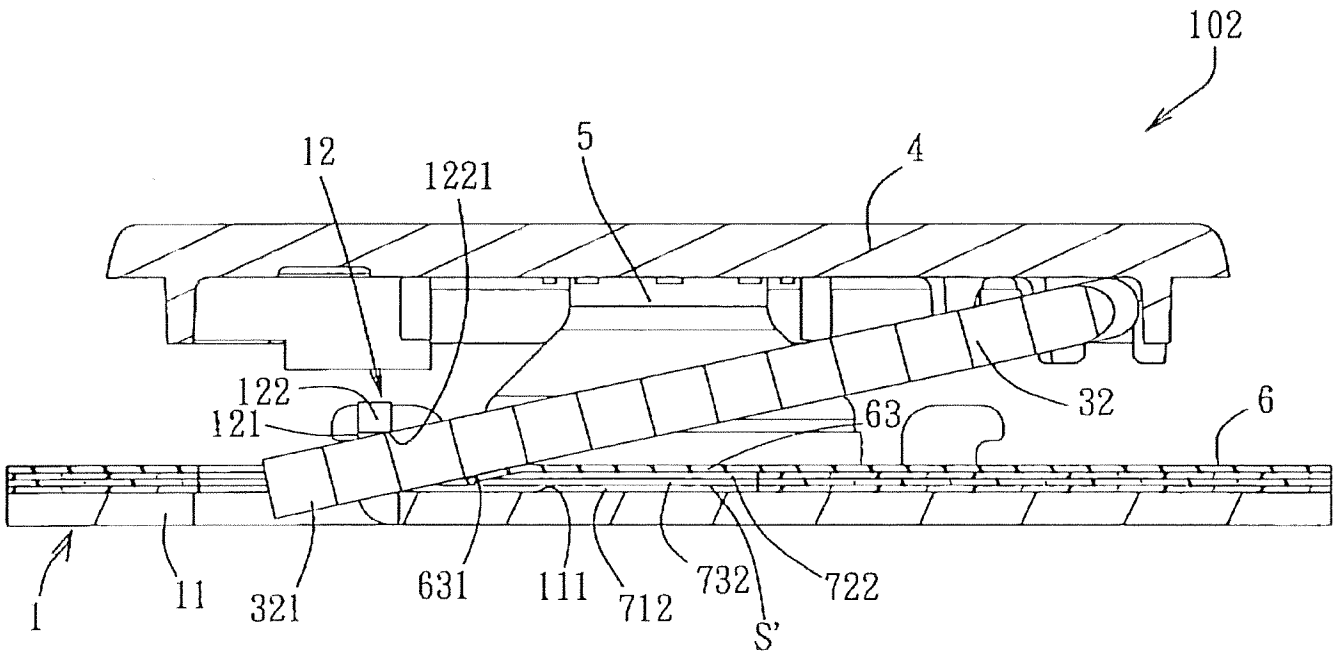
FIG. 14 is a sectional view of the third preferred embodiment in an assembled state.

Referring to FIGS. 13 and 14, a key device 102 according to the third preferred embodiment of the present invention is shown to be similar to the first preferred embodiment. However, in this embodiment, the key device 102 further comprises a sheet body 6 (for example, a light-shielding sheet or rubber sheet or mylar). Alternatively, the key device 102 may comprise a plurality of sheet bodies including the light-shielding sheet and the rubber sheet.

The sheet body 6 may be made of silicone disposed on the circuit unit 7 and disposed between the second circuit layer 72 and the keycap 4. The elastic member 5 is arranged on the sheet body 6. In one embodiment, the elastic member 5 may project upwardly from and form integrally as one piece with the sheet body 6. In an alternative embodiment, the elastic member 5 may be provided separately on the sheet body 6 or on the circuit unit 7. The sheet body 6, in this embodiment, is formed with two spaced-apart first slots 62 disposed on two opposite sides of the elastic member 5, respectively, and two first apertures 61 communicated with the respective first slots 62. The resilient tongues 63 are provided on the sheet body 6. Each resilient tongue 63 projects into a respective first slot 62 to divide the first slot 62 into two parallel first slot portions 621 both of which are communicated with one end of the corresponding first aperture 61. The first slot portions 621 and the first aperture 61 cooperatively form a substantially U-shaped hole structure. Each of the first, intermediate, and second circuit layers 71, 73, 72 of the circuit unit 7 is formed with two fourth slots 712, 732, 722 disposed below the respective resilient tongues 63. Each of the first, intermediate, and second circuit layers 71, 73, 72 of the circuit unit 7 is further formed with two fourth apertures 711, 731, 721 in communication with the respective slots 712, 732, 722. Each fourth slot 712, 732, 722 and the respective fourth aperture 711, 731, 721 cooperatively form a substantially T-shaped hole structure. When the first, intermediate, and second circuit layers 71, 73, 72 of the circuit unit 7 are superimposed and interconnected, the fourth slots 712, 732, 722 cooperatively form the indentation space (S') below the resilient tongue 63, so that the resilient tongue 63 can deform downward in the indentation space (S') when each second rod section 32 is pressed downward.

In the third preferred embodiment, each resilient tongue 63 is not formed on the circuit unit 7, but is formed on the sheet body 6 which is disposed on the circuit unit 7. When the support rod 3 is assembled between the keycap 4 and the substrate 1, the free end 631 of each resilient tongue 63 extends beneath and abuts against the lower end 321 of the respective second rod section 32, and pushes upwardly the respective second rod section 32 to abut against the edge 1221 confining the respective through hole 121, thereby eliminating a gap between the second rod section 32 and the edge 1221 of the inverted U-shaped structure 122. Thus, when the key device 100 vibrates due to an external force, the second rod sections 32 may be prevented from bumping onto the edge 1221 of the inverted U-shaped structure 122 to create low frequency noise.

Alternatively, the resilient tongues 63 formed on the sheet body 6 may also be configured as those shown in FIGS. 8 and 10.

In summary, through the presence of the resilient tongues 24, 291, 251, 28, 63, the second rod sections 32, 32' of the support rod 3, 3' can be supported and can be pushed upward by the resilient tongues 24, 291, 251, 28, 63 to abut against the respective positioning seats 12, 13, thereby eliminating the gap between each second rod section 32, 32' and the edge 1221 of the inverted U-shaped structure 122 of the respective positioning seat 12, 13, there by preventing each second rod section 32, 32' to bump against the edge 1221 and create low frequency noise. Hence, the object of the present invention can be realized. The word "on" used herein means one thing is placed upon another directly or indirectly.

Furthermore, in the first, second and third embodiments and the variations thereof, where the plate body of the substrate corresponds to the respective resilient tongue can also be hollowed and recessed such that the resilient tongue can be provided on the sheet body directly on the top face of the plate body or any layer of the multi-layered structure of the circuit unit.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A key device comprising:

a substrate including a plate body, and a positioning seat provided on a top face of said plate body and having a through hole;

a circuit unit disposed on said top face of said plate body and including a multi-layered structure, and a resilient tongue provided on one layer of said multi-layered structure, said resilient tongue having a free end proximate to said through hole;

a keycap disposed above said circuit unit;

an elastic member disposed between said circuit unit and said keycap; and a support rod connected to and supporting said keycap on said substrate, and having a lower end extending through said through hole, said free end of said resilient tongue extending beneath and abutting against said lower end of said support rod, and pushing upwardly said lower end of said support rod to abut against an edge confining said through hole.

2. The key device of claim 1, wherein said multi-layered structure includes a first circuit layer, a second circuit layer disposed above said first circuit layer, and an intermediate circuit layer disposed between said first and second circuit layers, said second circuit layer being formed with a first slot, said resilient tongue extending from said second circuit layer into said first slot, said first circuit layer being formed with a second slot disposed below said resilient tongue, said intermediate circuit layer being formed with a third slot disposed below said resilient tongue and communicated with said second slot.

3. The key device of claim 2, wherein said second circuit layer is further formed with a first aperture communicated with said first slot, said first circuit layer being further formed with a second aperture communicated with said second slot, said intermediate circuit layer being further formed with a third aperture communicated with said third slot, said first, second and third apertures being communicated and aligned with each other and cooperatively defining a hollow area, said positioning seat extending through said circuit unit through said hollow area, so that said free end of said resilient tongue is proximate to said through hole.

4. The key device of claim 3, wherein said resilient tongue extends into said first slot to divide said first slot into two slot portions both of which are communicated with one end of said first aperture, said resilient tongue extending in a direction parallel to an extending direction of said through hole.

5. The key device of claim 3, wherein said resilient tongue extends into said first slot so that said resilient tongue covers a portion of said first slot and so that said first slot has an L-shaped uncovered portion.

6. The key device of claim 1, wherein said multi-layered structure includes a first circuit layer, a second circuit layer disposed above said first circuit layer, and an intermediate circuit layer disposed between said first and second circuit layers, said intermediate circuit layer being formed with a first slot, said resilient tongue extending from said intermediate circuit layer into said first slot, said first circuit layer being formed with a second slot disposed below said resilient tongue, said second circuit layer being formed with a third slot disposed above said resilient tongue.

7. The key device of claim 6, wherein said intermediate circuit layer is further formed with a first aperture communicated with said first slot, said first circuit layer being further formed with a second aperture communicated with said second slot, said second circuit layer being further formed with a third aperture communicated with said third slot, said first, second, and third apertures being communicated and aligned with each other and cooperatively defining a hollow area, said positioning seat extending through said circuit unit through said hollow area, so that said free end of said resilient tongue is proximate to said through hole.

8. The key device of claim 7, wherein said resilient tongue extends into said first slot to divide said first slot into two slot portions both of which are communicated with one end of said first aperture, said resilient tongue extending in a direction parallel to an extending direction of said through hole.

9. The key device of claim 7, wherein said first slot has an L-shaped configuration, said resilient tongue extending in a direction perpendicular to an extending direction of said through hole.

10. The key device of claim 1, wherein said support rod includes two second rod sections, and a first rod section connected between said second rod sections and connected to said keycap, each of said second rod sections having an upper end connected integrally as one piece to one end of said first rod section, and having said lower end.

11. The key device of claim 1, wherein said support rod includes two second rod sections having upper ends connected to said keycap, each of said second rod sections having said lower end.

12. A key device comprising:

a substrate including a plate body, and a positioning seat provided on a top face of said plate body and having a through hole;

a sheet body disposed on said top face of said plate body and formed with a resilient tongue having a free end proximate to said through hole;

an elastic member arranged on said sheet body;

a keycap disposed on said elastic member; and a support rod connected to said keycap and having a lower end extending through said through hole, said free end of said resilient tongue extending beneath and abutting against said lower end of said support rod, and pushing upwardly said lower end of said support rod to abut against an edge confining said through hole.

13. The key device of claim 12, wherein said sheet body is formed with a first slot, and a first aperture communicated with said first slot, said resilient tongue extending into said first slot.

14. The key device of claim 13, wherein said first slot has an L-shaped configuration.

15. The key device of claim 13, wherein said resilient tongue extends into said first slot to divide said first slot into two slot portions both of which are communicated with one end of said first aperture.

16. The key device of claim 12, further comprising a circuit unit disposed between said plate body and said sheet body, said circuit unit being formed with an indentation space below said resilient tongue, so that said resilient tongue is deformable downward in said indentation space.

17. The key device of claim 12, wherein said support rod includes two second rod sections, and a first rod second connected between said second rod sections and connected to said keycap, each of said second rod sections having an upper end connected integrally as one piece to one end of said first rod second, and having said lower end.

18. The key device of claim 12, wherein said support rod includes two second rod sections having upper ends connected to said keycap, each of said rod sections having said lower end.

* * * * *